US005887612A

United States Patent [19]

Bleitz et al.

[11] Patent Number: 5,887,612

[45] Date of Patent: Mar. 30, 1999

[54] HYDRAULIC PUMP APPARATUS

[75] Inventors: Daniel J. Bleitz, Wixom; Luigi Mastrofrancesco, Livonia, both of Mich.

[73] Assignee: Ford Global Technologies, Inc., Dearborn, Mich.

[21] Appl. No.: 921,077

[22] Filed: Aug. 29, 1997

[51] Int. Cl.[6] ..... F16K 27/04

[52] U.S. Cl. ..... 137/315; 137/115.09; 251/151

[58] Field of Search ..... 137/15, 315, 115.04, 137/115.09; 251/151

[56] References Cited

U.S. PATENT DOCUMENTS

| | | | |
|---|---|---|---|
| 3,667,725 | 6/1972 | Scaramucci | 137/315 X |
| 4,549,566 | 10/1985 | Fujiwara et al. | 137/115.09 |
| 5,161,959 | 11/1992 | Gettel | 417/300 |
| 5,253,842 | 10/1993 | Huebscher et al. | 137/315 X |
| 5,339,856 | 8/1994 | Templar | 137/315 X |
| 5,467,611 | 11/1995 | Cummings et al. | 251/151 X |

*Primary Examiner*—Stephen M. Hepperle
*Attorney, Agent, or Firm*—Gregory P. Brown

[57] ABSTRACT

A hydraulic apparatus as used for providing fluid to a steering gear of an automotive vehicle includes a housing (10) having a valve bore (14) housing a relief valve spool (94) disposed therein and slidable between a first and second position. A discharge connector (88) is disposed on a first end of the valve bore (14) and forms a fluid passage for communicating fluid through the first end of the valve bore to a power steering actuator. An annular retainer (90) is disposed in the valve bore between the first position of the spool valve (94) and the discharge connector (88). The annular retainer includes an outer periphery (130) sized for interference fit engagement with said valve bore (14) for retaining the spool valve (94) within the valve bore (14) when the discharge connector (88) is removed from the first end of the valve bore.

18 Claims, 3 Drawing Sheets

HYDRAULIC PUMP APPARATUS

BACKGROUND OF THE INVENTION

1. Field of the Invention

This invention relates generally to hydraulic pumps as used in automotive vehicles. More particularly, the present invention relates to hydraulic devices, such as pumps, having a slidable valve within a bore, and specifically to an apparatus for retaining the valve within the bore while the device is being serviced.

2. Disclosure Information

Hydraulic pumps are well known to those skilled in the hydraulics art, as are many forms of actuators having sliding valves therein. Commonly these valves are used to control fluid flow within the pump, actuator etc. The valves are commonly located within a valve bore and are free to slide between at least two predetermined positions. Additionally, the bore is generally manufactured to allow the valve to slide completely out at least one end of the bore. This accommodates assembly, and where necessary, service of the valve assembly.

It was recently observed that in certain circumstances, it is desirable to orient power steering pumps such that a longitudinal axis the bore is generally aligned parallel to the vertical axis as installed in the vehicle. It was further observed that during service of hydraulic lines and connectors attaching to the pump, the valve could be displaced from the bore inadvertently. Thus necessitating service of the valve assembly where not necessarily required.

It would therefore be advantageous to provide a hydraulic apparatus that could be oriented having a vertical valve bore that would not require inadvertent service of the valve assembly during service of hydraulic lines and their associated connectors.

SUMMARY OF THE INVENTION

Accordingly, the present invention provides a hydraulic apparatus providing positive retention of a valve within a bore, such that the hydraulic apparatus may be serviced without inadvertently requiring valve service. An example of the hydraulic apparatus, such as the type used for providing fluid to a steering gear of an automotive vehicle has been described herein.

The hydraulic apparatus includes a housing having a valve bore and first and second ends therein. The hydraulic apparatus further includes a spool valve disposed in the valve bore and slidable between a first and second position and a discharge connector having threads on an outer circumference thereof for engaging internal threads disposed on the first end of the valve bore. The discharge connector forms a fluid passage for communicating fluid through the first end of the valve bore.

The hydraulic apparatus also includes an annular retainer disposed in the valve bore between the first position of the spool valve and the discharge connector, the annular retainer having an outer periphery sized for interference fit engagement with the valve bore for retaining the spool valve within the valve bore when the discharge connector is removed from the first end of the valve bore.

Advantageously, the annular retainer positively retains the spool valve within the valve bore in the absence of the discharge connector, allowing service of the discharge connector and any associated components, such as fluid line and couplings, without requiring inadvertent service of the spool valve.

DETAILED DESCRIPTION OF THE PREFERRED EMBODIMENT

Figure 1:
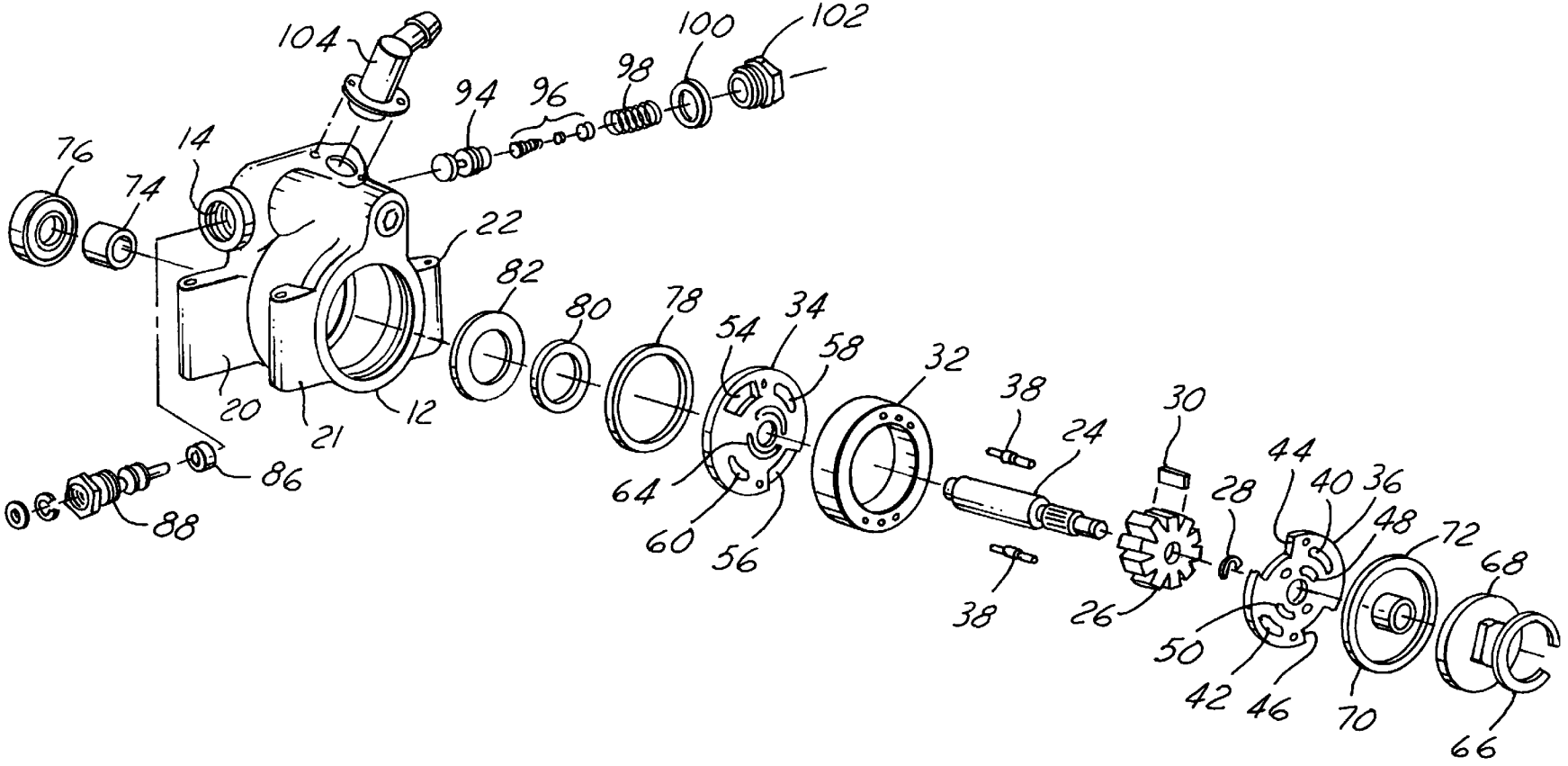
FIG. 1 is an isometric view of a power steering pump, showing its elements spaced axially from adjacent components as constructed in accordance with the present invention.
Figure 2:
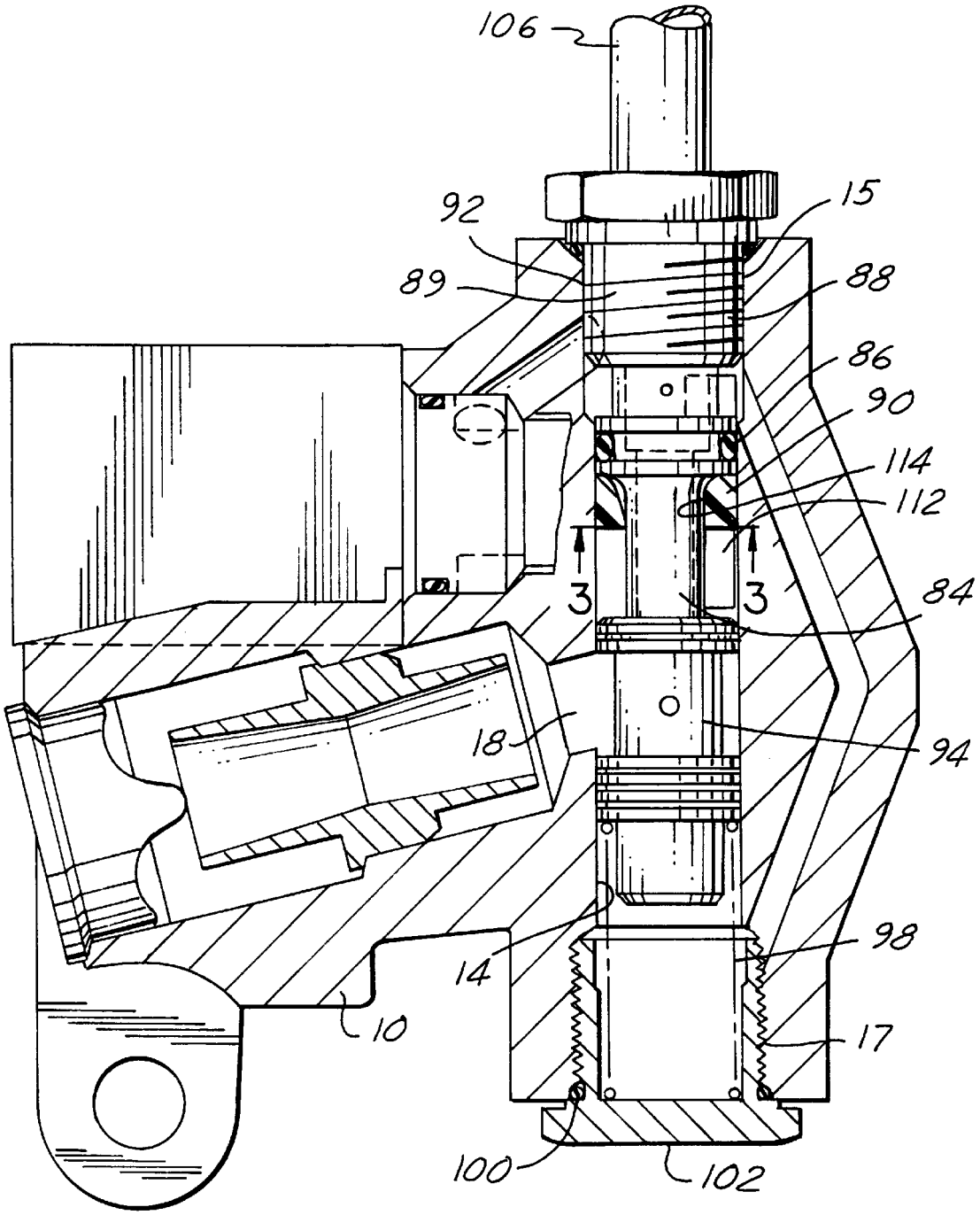
FIG. 2 is a cut away view of the power steering relief valve and adjacent housing area of the power steering pump with the components disposed in the low speed position in accordance with the present invention.
Figure 4:
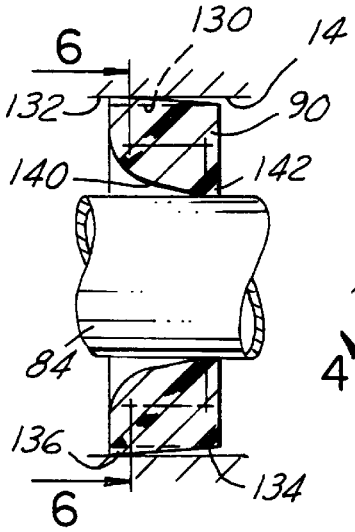
FIG. 4 is a partial sectional view taken along line 4—4 from FIG. 3 of an annular retainer constructed in accordance with the present invention.
Figure 3:
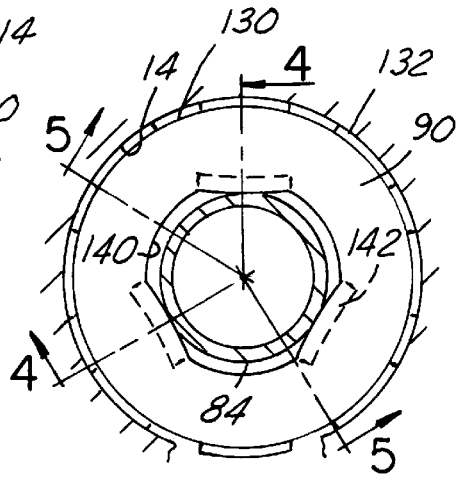
FIG. 3 is a partial cross section view taken along line 3—3 from FIG. 2 of an annular retainer constructed in accordance with the present invention.
Figure 5:
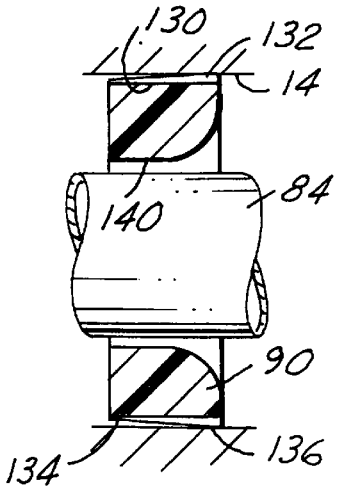
FIG. 5 is a partial sectional view taken along line 5—5 from FIG. 4 showing the details of an annular retainer constructed in accordance with the present invention.
Figure 6:
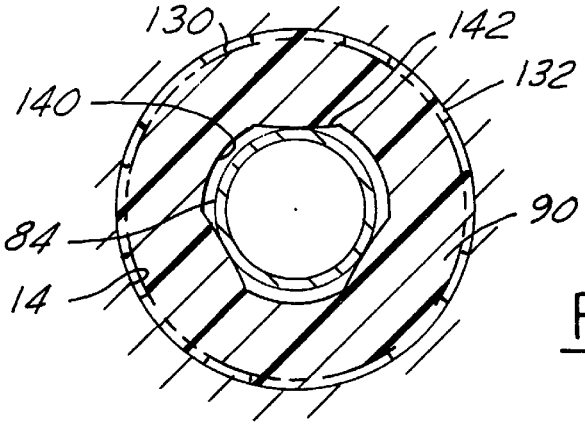
FIG. 6 is a partial sectional view taken along line 6—6 from FIG. 4 of an annular retainer constructed in accordance with the present invention.

Referring now to FIGS. 1 and 2, the present invention will now be described as applied to a power steering pump as used in a automotive vehicle. It should be recognized, however, that the present invention may be employed with similar advantage in many hydraulic devices having internal valve mechanisms and external hydraulic lines, such as suspension actuators, hydraulic brake devices, etc.

A rotary vane hydraulic power steering pump constructed in accordance with the present invention supplies pressurized fluid to an automotive vehicle steering gear. The pump includes a housing 10 defining a cylindrical space 12 containing the pumping elements, a bore 14 having first and second ends 15, 17 containing a flow control valve and related components and a diffuser passage 18. The housing includes at least three bosses 20–22, each having a cylindrical hole adapted to receive a mechanical attachment such as a bolt, which can be threaded directly to the engine block of the vehicle. In this way, the conventional bracket usually used to support a power steering pump located in position to be driven by a belt from the engine crankshaft can be eliminated.

The components that pump hydraulic fluid from a reservoir to the steering gear are rotatably supported on a shaft 24, driven by an endless drive belt from an engine and rotatably connected by a splined connection to a rotor 26 fixed in position on the shaft by a snap ring 28. The rotor has ten radially sliding vanes 30, held in contact with the inner surface of a cam ring 32 having two arcuate zones extending angularly in rise or inlet quadrants and two zones of lesser radial size extending angularly in fall or outlet quadrants mutually separated by the inlet quadrants. A lower pressure plate 34 and an upper pressure plate 36 are fixed in position radially with respect to the cam 32 by alignment pins 38. Formed through the thickness of the upper pressure plate are arcuate outlet ports 40, 42 communicating with an outlet port opening to the flow control valve bore 14, inlet ports 44, 46 and arcuate passages 48, 50 for use in cold starting priming. The lower pressure plate has inlet ports 56, 54 formed through its thickness, outlet ports 58, 60 and arcuate flow passages 62, 64 hydraulically connected to passages 48, 50.

A wire retaining ring 66 seats within a recess at the end of the pump housing to hold in position a pump cover 68. Bushing 70 supports shaft 24 on a recess in the inner surface of the cover. Seal 72 prevents the passage of hydraulic fluid.

The opposite end of the rotor shaft is supported rotatably in a bushing 74, which is supported on the housing; a shaft seal 76 prevents flow of hydraulic fluid from the pumping chambers. Located adjacent the lower pressure plate on the opposite side from the cam are an inner seal 78, an outer seal 80, and a Belleville spring 82, which develops an axial force tending to force mutually adjacent surfaces of the various components into abutting contact.

Located within bore 14 are a discharge port orifice 84, integrally formed with a discharge connector 88, a seal 86, and an annular retainer ring 90. The discharge connector 88 has a threaded portion 89 for engagement with a threaded portion 92 of the valve bore 14. Also located within bore 14 is a relief valve spool 94, a coiled compression spring, ball, and ball seat 96 and a larger compression spring 98 urging spool 94 toward a first position where the flow control valve is closed corresponding to low pump speed operation. A seal 100 and plug 102 close the adjacent end of the bore mechanically and hydraulically.

A tube assembly 104 connects a tube carrying fluid from the steering gear to the pump housing, through which it passes in suitable ports to the pumping chamber.

Referring now to FIGS. 2 through 6, the annular retainer ring 90 is disposed within the bore 14 between a first position of the valve spool 94 and the inner end of the discharge connector 88. The annular retainer 90 includes an outer periphery 130 sized for interference fit engagement with the bore 14. In the preferred embodiment, the outer periphery of the annular retainer includes a plurality of protuberances 132 projecting radially outward for engagement with the bore 14. The protuberances may be tapered, having a low end 134 of the taper adjacent to the valve spool 94 and the high end 136 adjacent to the discharge connector 88.

The annular retainer 90 also includes an inner periphery 140 sized for interference fit engagement with the discharge port orifice 84. The inner periphery 140 may include flats 142 protruding inwardly from the otherwise circular periphery of the annular retainer. Depending on the amount of interference desired, small flats may be formed just adjacent to the spool valve 94, or if greater interference is desired, larger flats may extend further into the inner periphery 140 of the annular retainer 90.

Advantageously, the amount of taper on the protuberances 132 and the size of the flats 142 can be varied so as to create a relationship permitting the removal of the discharge port orifice without causing the annular retainer to be removed from the bore 14. This is accomplished by the combination of greater surface area contacted by the outer diameter than the inner diameter together with a sufficient taper on the protuberances 132 to create a higher retaining force than that created by the interference between the flats and the discharge port orifice. This is particularly advantageous where automated assembly equipment is used and the retainer 90 must stay on the discharge port orifice until it is assembled into the valve bore.

Figure 7:
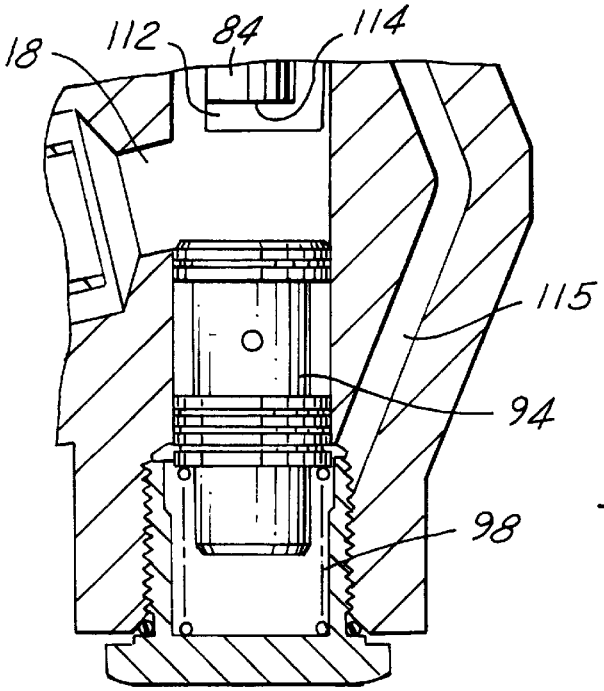
FIG. 7 is a cross section through the power steering relief valve and adjacent housing area of the power steering pump with the components disposed in the high speed position in accordance with the present invention.

Operation of the relief valve spool 94 will now be described with reference to FIGS. 2 and 7. Pressurized fluid flows from the outlet ports in the pressure plates through port 112 to bore 14 in which relief valve spool 94 is located. Orifice 84 has an axially directed passage 114, which continually connects port 112 to the pressure tube 116, which carries high pressure hydraulic fluid to the steering gear from the pump.

The flow rate through port 112 is proportional to the speed of the pump shaft 24 and to the speed of the engine to which that shaft is connected. Directing fluid flow into passage 114 produces a pressure drop relative to pressure at port 112. Pressure downstream of aperture 114, the steering system pressure, is fed back in passage 115 to the end of the relief valve spool 94 contacted by spring 98. A force resulting from the feedback pressure adds to the spring force on the spool. When pump speed increases, hydraulic system pressure in port 112 increases, thereby forcing relief valve spool 94, against the effect of compression spring 98 and the feedback pressure, away from the first position toward a second position (as shown in FIG. 7) where additional fluid flow is bled back to a fluid reservoir through the diffuser passage 18. This operating condition may also be referred to as the high speed operating mode, as it occurs when the pump operates at high speeds.

In the event the discharge connector 88 must be removed, such as to service pressure tube 116, the spring 98 urges the relief valve spool 94 against the annular retainer 90. The annular retainer 90 positively resists sliding of the relief valve spool 94, so as to prevent inadvertent disassembly of the relief valve spool 94. A hooked object may be inserted in bore 14 to forcibly remove the retainer 90 if servicing the relief valve spool 94 is specifically desired.

The foregoing description presents a preferred embodiment of the present invention. Details of construction have been shown and described for purposes of illustration rather than limitation. Modifications and alterations of the invention such as this will no doubt occur to those skilled in the art that will come within the scope and spirit of the following claims.

We claim:

1. A hydraulic apparatus such as the type used for providing fluid to a steering gear of an automotive vehicle, comprising:

a housing having a valve bore therein, said valve bore having first and second ends;

a spool valve disposed in said valve bore and slidable between a first and second position;

a discharge connector having threads on an outer circumference thereof for engaging internal threads disposed on said first end of said valve bore, said discharge connector forming a fluid passage for communicating fluid through said first end of said valve bore; and an annular retainer disposed in said valve bore between said first position of said spool valve and said discharge connector, said annular retainer having an outer periphery sized for interference fit engagement with said valve bore for retaining said spool valve within said valve bore when said discharge connector is removed from said first end of said valve bore.

2. An apparatus according to claim 1, further comprising a discharge port orifice attached to said discharge connector, said annular retainer having an inner periphery sized for interference fit with said discharge port orifice.

3. An apparatus according to claim 1, wherein said outer periphery of said annular retainer includes a plurality of protuberances projecting outward to engage said valve bore, thereby creating said interference fit.

4. An apparatus according to claim 3, wherein said protuberances include an outward taper having a low end adjacent to said spool valve and a high end adjacent to said discharge connector.

5. An apparatus according to claim 2, wherein said inner periphery of said annular retainer includes at least one flat portion for creating said interference fit with said discharge port orifice.

6. An apparatus according to claim 5, wherein said flat portion only projects inward from said inner periphery adjacent to said spool valve.

7. An apparatus according to claim 2, wherein said interference fit between said outer periphery of said annular retainer and said valve bore creates a greater retaining force than said interference fit between said inner diameter of said annular retainer and said discharge port orifice, such that said discharge connector and said discharge port orifice can be removed from said valve bore without removing said annular retainer from said valve bore.

8. A hydraulic apparatus such as the type used for providing fluid to a steering gear of an automotive vehicle, comprising:

a housing having a valve bore therein, said valve bore having first and second ends;

a spool valve disposed in said valve bore and slidable between a first and second position in response to a pressure differential acting thereon;

an outlet port through which pressurized fluid enters said valve bore;

a discharge port orifice attached to a discharge connector forming a fluid passage for communicating fluid to the steering gear; and a circular retainer disposed in said valve bore between said outlet port and said discharge connector, said circular retainer having an outer periphery sized for interference fit engagement with said valve bore and having an inner periphery for interference fit with said discharge port orifice.

9. An apparatus according to claim 8, wherein said outer periphery of said annular retainer includes a plurality of protuberances projecting outward to engage said valve bore, thereby creating said interference fit.

10. An apparatus according to claim 9, wherein said protuberances include an outward taper having a low end adjacent to said spool valve and a high end adjacent to said discharge connector.

11. An apparatus according to claim 8, wherein said inner periphery of said annular retainer includes at least one flat portion for creating said interference fit with said discharge port orifice.

12. An apparatus according to claim 11, wherein said flat portion only projects inward from said inner periphery adjacent to said spool valve.

13. An apparatus according to claim 8, wherein said interference fit between said outer periphery of said annular retainer and said valve bore creates a greater retaining force than said interference fit between said inner diameter of said annular retainer and said discharge port orifice, such that said discharge connector and said discharge port orifice can be removed from said valve bore without removing said annular retainer from said valve bore.

14. A hydraulic power steering pump such as the type used for providing fluid to a steering gear of an automotive vehicle, comprising:

a housing having a valve bore therein, said valve bore having first and second ends;

a spool valve disposed in said valve bore and slidable between a first and second position in response to a pressure differential acting thereon;

an outlet port through which pressurized fluid enters said valve bore;

a discharge port orifice attached to a discharge connector forming a fluid passage for communicating fluid to the steering gear; and a circular retainer disposed in said valve bore between said outlet port and said discharge connector, said circular retainer having an outer periphery sized for interference fit engagement with said valve bore and having an inner periphery for interference fit with said discharge port orifice;

whereby said interference fit between said outer periphery of said annular retainer and said valve bore creates a greater retaining force than said interference fit between said inner periphery of said annular retainer and said discharge port orifice, such that said discharge connector and said discharge port orifice can be removed from said valve bore without removing said annular retainer from said valve bore.

15. An apparatus according to claim 14, wherein said outer periphery of said annular retainer includes a plurality of protuberances projecting outward to engage said valve bore, thereby creating said interference fit.

16. An apparatus according to claim 15, wherein said protuberances include an outward taper having a low end adjacent to said spool valve and a high end adjacent to said discharge connector.

17. An apparatus according to claim 14, wherein said inner periphery of said annular retainer includes at least one flat portion for creating said interference fit with said discharge port orifice.

18. An apparatus according to claim 17, wherein said flat portion only projects inward from said inner periphery adjacent to said spool valve.

* * * * *